US011071886B1

(12) United States Patent
Scholten

(10) Patent No.: US 11,071,886 B1
(45) Date of Patent: Jul. 27, 2021

(54) MULTIFUNCTIONAL EXERCISE EQUIPMENT

(71) Applicant: Markus Leo Scholten, Irvine, CA (US)

(72) Inventor: Markus Leo Scholten, Irvine, CA (US)

(73) Assignee: Core-X Life and Fitness, Inc., Laguna Beach, CA (US)

( * ) Notice: Subject to any disclaimer, the term of this patent is extended or adjusted under 35 U.S.C. 154(b) by 0 days.

(21) Appl. No.: 16/725,794

(22) Filed: Dec. 23, 2019

Related U.S. Application Data

(60) Provisional application No. 62/785,644, filed on Dec. 27, 2018.

(51) Int. Cl.
*A63B 22/00* (2006.01)
*A63B 21/22* (2006.01)
*A63B 21/00* (2006.01)

(52) U.S. Cl.
CPC ..... *A63B 22/0007* (2013.01); *A63B 21/153* (2013.01); *A63B 21/154* (2013.01); *A63B 21/225* (2013.01); *A63B 21/4031* (2015.10); *A63B 21/4034* (2015.10); *A63B 22/0076* (2013.01); *A63B 2022/0035* (2013.01); *A63B 2022/0041* (2013.01); *A63B 2022/0079* (2013.01)

(58) Field of Classification Search
CPC ..... A63B 21/4043; A63B 21/4045; A63B 21/225; A63B 21/154; A63B 21/153; A63B 21/4031; A63B 22/0007; A63B 22/0076; A63B 22/0087; A63B 2022/0041; A63B 2022/0035; A63B 2022/0079–0082; A63B 23/1263; A63B 69/18–2069/185; A63B 2244/19; A63B 69/187
See application file for complete search history.

(56) References Cited

U.S. PATENT DOCUMENTS 4,434,981 A * 3/1984 Norton ..... A63B 21/00072 482/51
4,867,443 A * 9/1989 Jensen ..... A63B 22/001 482/70
4,900,013 A * 2/1990 Rodgers, Jr. ..... A63B 21/00178 482/6

(Continued)

OTHER PUBLICATIONS

Written Opinion of the International Searching Authority for international application PCT/US2019/068478, 5 pages, dated Mar. 4, 2020. (Year: 2020).*

*Primary Examiner* — Megan Anderson
*Assistant Examiner* — Kathleen Vermillera
(74) *Attorney, Agent, or Firm* — Plager Schack LLP; Mark H. Plager; Kara K. Verryt

(57) ABSTRACT

A multifunctional cardiovascular exercise machine may include a frame including a first and second end attached to one another by a pair of ski rails and a centrally located center frame rail. A flywheel may be operatively mounted to the frame, and a pulley system may be mounted to the frame, the pulley system supporting and routing a pull rope, wherein the pull rope is operatively engaged with the flywheel, and a free end of the pull rope is removably engaged with a pull bar, a pair of ski poles, and/or a pair of pull handles. A sliding seat may be operatively attached to the flywheel and slidably mounted to the center frame rail, and a pair of footrests may be mounted to the frame proximate to the flywheel.

9 Claims, 6 Drawing Sheets

(56) References Cited

U.S. PATENT DOCUMENTS

| | | | | |
|---|---|---|---|---|
| 5,443,433 | A * | 8/1995 | Krag | A63B 21/153 482/51 |
| 5,469,882 | A | 11/1995 | Condon | |
| 5,961,423 | A | 10/1999 | Sellers | |
| 6,168,554 | B1 * | 1/2001 | Berg | A63B 22/0076 482/138 |
| 6,183,398 | B1 | 2/2001 | Rufino et al. | |
| 8,986,167 | B2 * | 3/2015 | Olsen | A63B 21/154 482/51 |
| 10,675,500 | B2 * | 6/2020 | Wang | A63B 21/153 |
| 2017/0361152 | A1 * | 12/2017 | Hou | A63B 21/005 |

* cited by examiner

MULTIFUNCTIONAL EXERCISE EQUIPMENT

RELATED APPLICATION

This application claims priority to provisional patent application U.S. Ser. No. 62/785,644 filed on Dec. 27, 2018, the entire contents of which is herein incorporated by reference.

BACKGROUND

The embodiments described herein relate generally to exercise equipment, and more particularly, to exercise equipment designed to mimic the motion of any variety of rowing techniques, including kayaking, canoeing, Paddle-boarding, and the like as well as cross country skiing and weight training.

Conventionally, to perform particular exercises, such as rowing, cardio weight training, and skiing, an individual must utilize a multitude of different machines, requiring individuals to either own multiple machines or go to a gym that has various different machines.

Therefore, what is needed is a cardiovascular exercise machine that offers a plurality of different types of cardio-vascular exercises, including rowing, kayaking, and cross-country skiing, while simultaneously offering a multitude of muscle conditioning and body building exercises.

SUMMARY

Some embodiments of the present disclosure include a multifunctional cardiovascular exercise machine may include a frame including a first and second end attached to one another by a pair of ski rails and a centrally located center frame rail. A flywheel may be operatively mounted to the frame, and a pulley system may be mounted to the frame, the pulley system supporting and routing a pull rope, wherein the pull rope is operatively engaged with the flywheel, and a free end of the pull rope is removably engaged with a pull bar, a pair of ski poles, and/or a pair of pull handles. A sliding seat may be operatively attached to the flywheel and slidably mounted to the center frame rail, and a pair of footrests may be mounted to the frame proximate to the flywheel.

BRIEF DESCRIPTION OF THE FIGURES

The detailed description of some embodiments of the invention is made below with reference to the accompanying figures, wherein like numerals represent corresponding parts of the figure.

DETAILED DESCRIPTION

Figure 1:
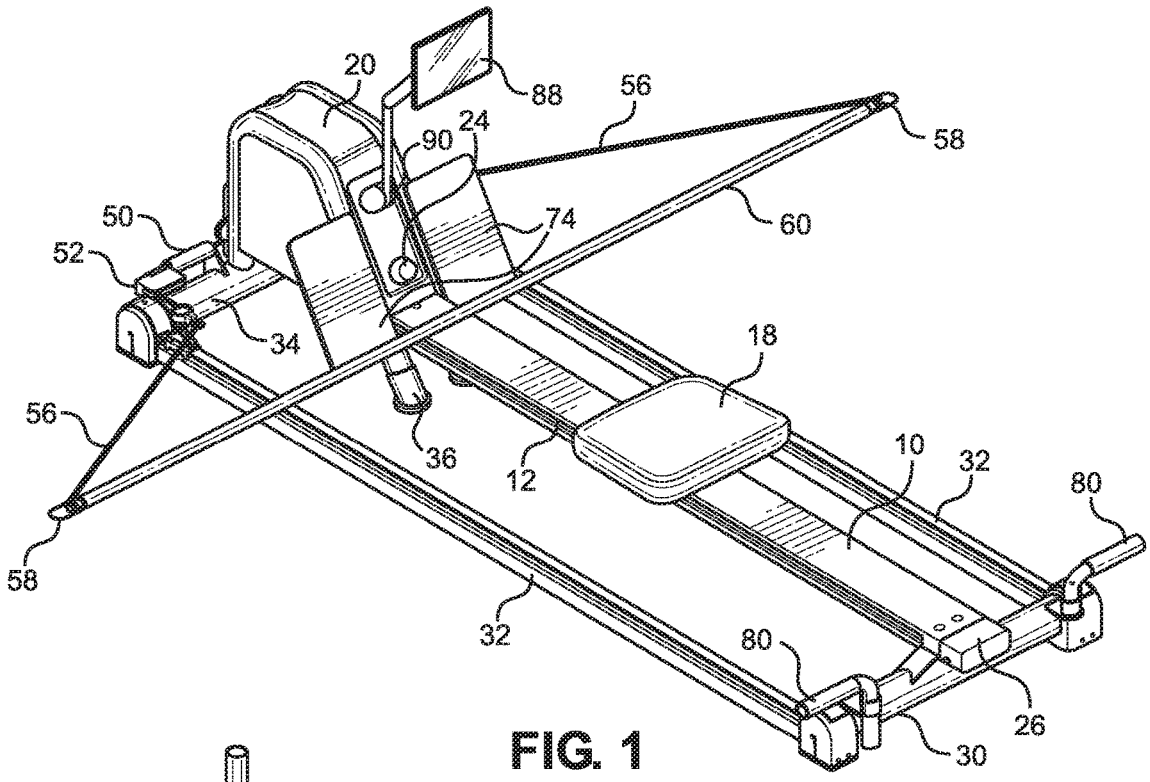
FIG. 1 is a back perspective view of one embodiment of the present disclosure.
Figure 2A:
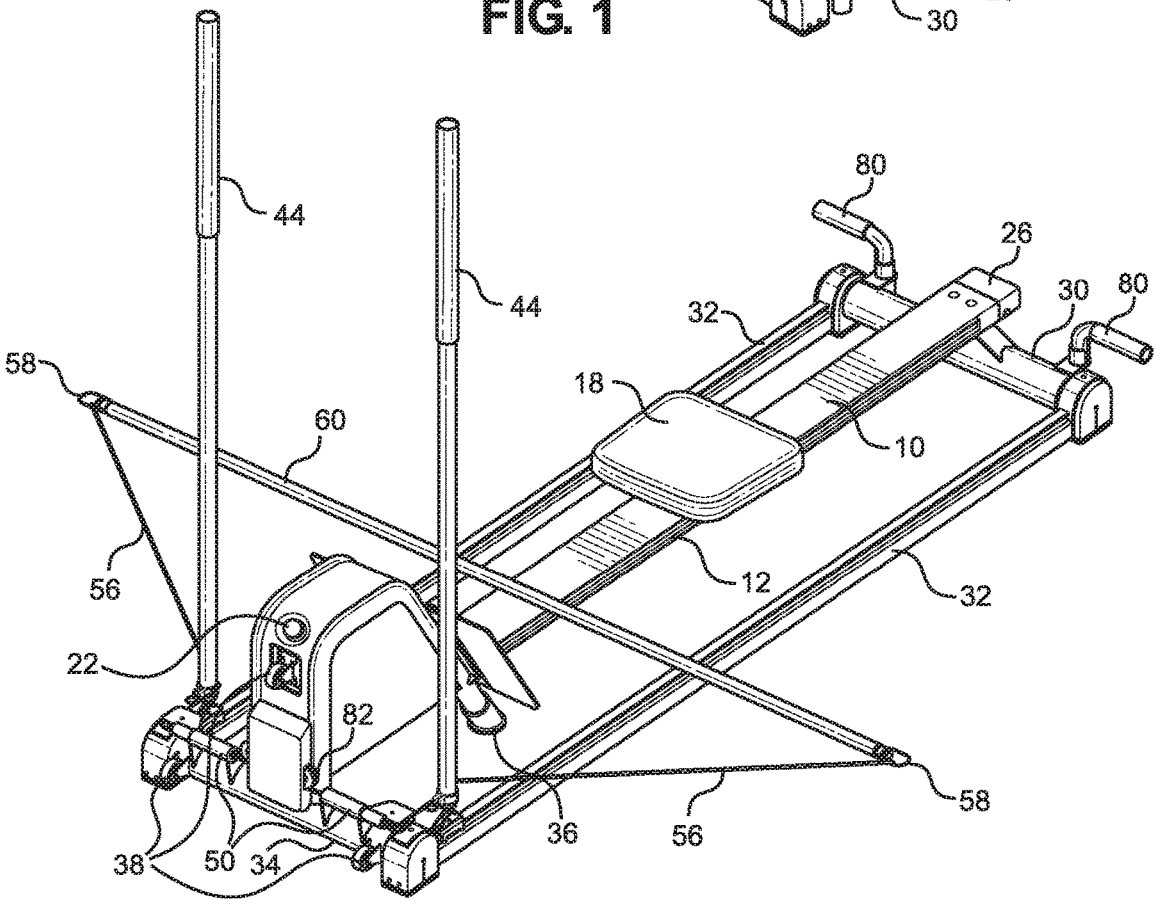
FIG. 2A is a front perspective view of one embodiment of the present disclosure.
Figure 2B:
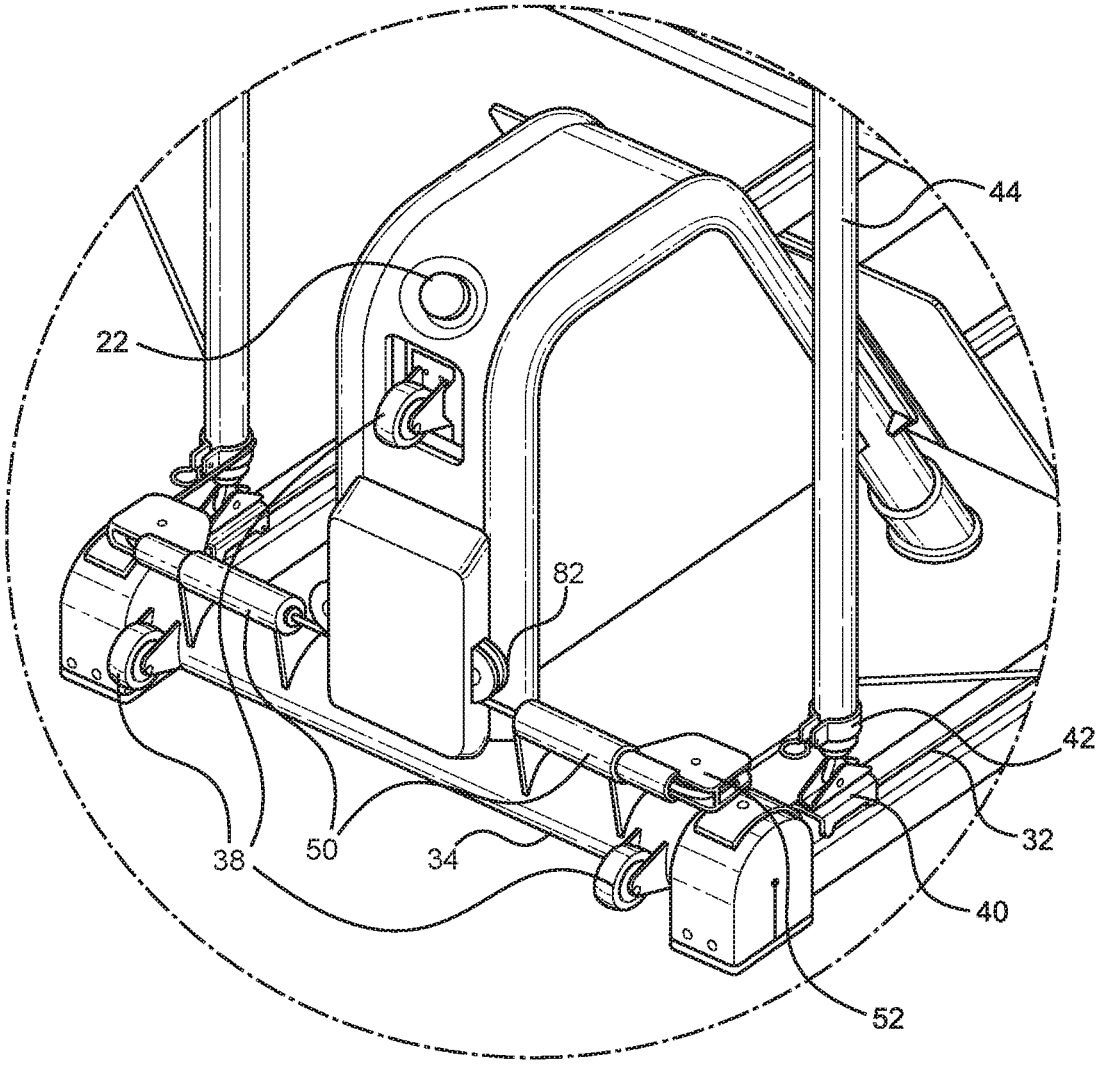
FIG. 2B is a close-up front perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The method of the present disclosure may be used as a multifunctional cardiovascular exercise machine and may comprise the following elements. This list of possible constituent elements is intended to be exemplary only, and it is not intended that this list be used to limit the method of the present application to just these elements. Persons having ordinary skill in the art relevant to the present disclosure may understand there to be equivalent elements that may be substituted within the present disclosure without changing the essential function or operation of the method.

a. Frame
b. Sliding Seat
c. Flywheel
d. Ski Rail
e. Hand Poles
f. Pull Rope with Bar or Handle Attachments
g. Foot Rests
h. Pulley System The various elements of the present disclosure may be related in the following exemplary fashion. It is not intended to limit the scope or nature of the relationships between the various elements and the following examples are presented as illustrative examples only.

By way of example, and referring to FIGS. 1-10, some embodiments of the invention include a multifunctional cardiovascular exercise machine for practicing a plurality of types of cardiovascular and weight training exercises, the machine comprising a frame defining a horizontal portion of the exercise machine; a flywheel 64 operatively mounted to the frame; a sliding seat 18 operatively mounted the flywheel 64 and slidably mounted to the frame; a pair of ski rails 32 built into the frame; a pull rope 56 operatively attached to the frame, wherein at least one attachment is designed to removably engage with a free end of the pull rope 56; a pair of poles 44 mounted to the ski rails 32; a pair of footrests 74 mounted to the frame; and at least one pulley system mounted onto the frame, the pulley system providing for the movement of at least one member selected from the group consisting of the sliding seat 18, the pull rope 56, and the ski poles 44. Because of the structure of the machine of the present disclosure, the machine may provide multiple options for exercising, including rowing, cross-country skiing, and weight training.

As described above, the machine may include a frame. As shown in the Figures, the frame may be substantially elongate and in some embodiments comprises a first foot 30, a second foot 34 spaced from the first foot 30, a first ski rail 32 extending from a first outer edge of the first foot 30 to a first outer edge of the second foot 34 and a second ski rail 32 extending from a second outer edge of the first foot 30 to a second outer edge of the second foot 34, thus creating a substantially rectangular frame. A center frame rail 10 with a seat slide track 12 built into a surface thereof, such as into the side surfaces thereof, may extend from the second foot 34 to or slightly past the first foot 30, wherein the center frame rail 10 may be substantially parallel to the ski rails 32 and substantially perpendicular to the first foot 30 and the second foot 34. As shown in the Figures, the center frame rail 10 may be attached to an upper surface of each of the first foot 30 and the second foot 34.

Figure 3:
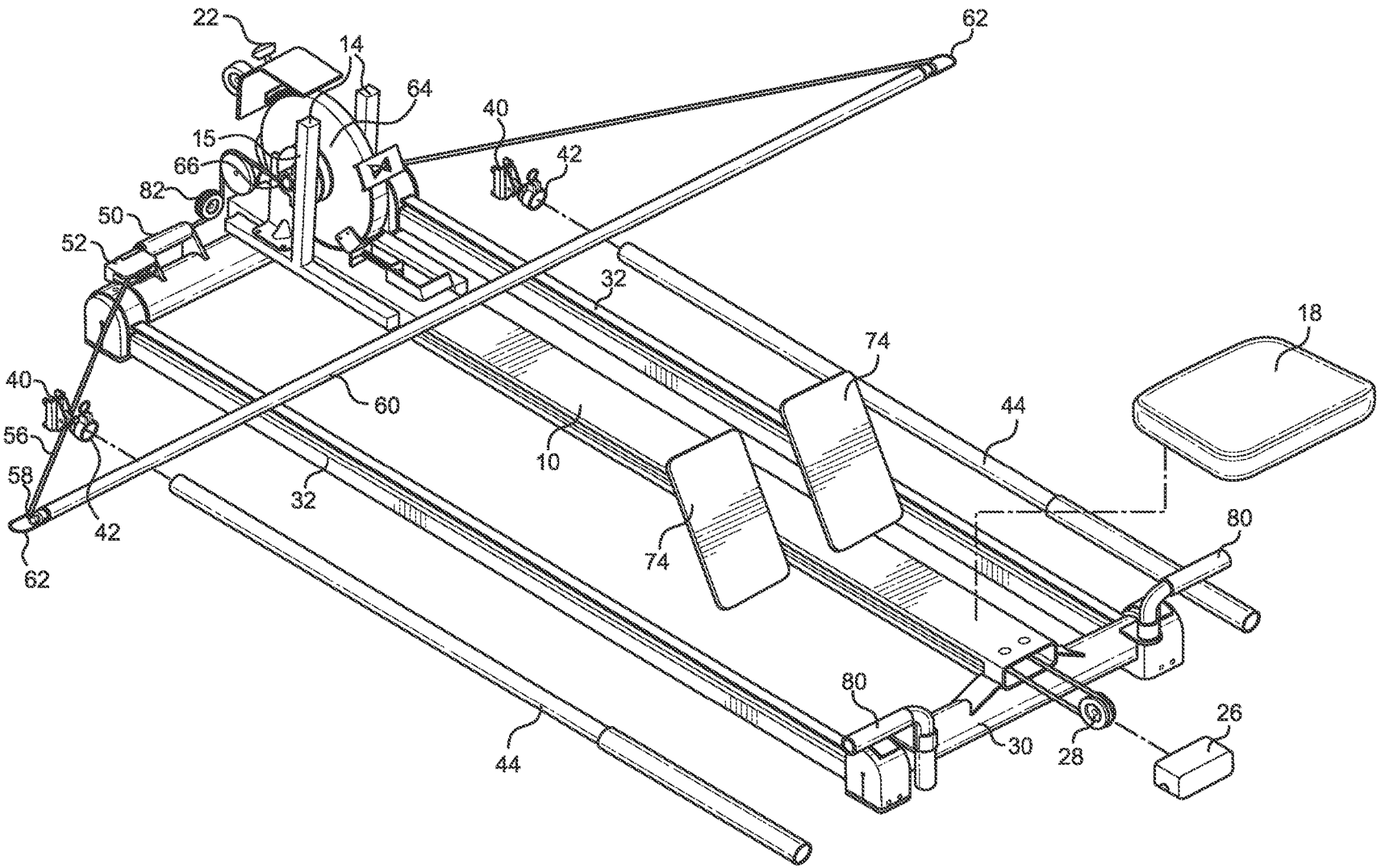
FIG. 3 is an exploded view of one embodiment of the present disclosure.
Figure 4:
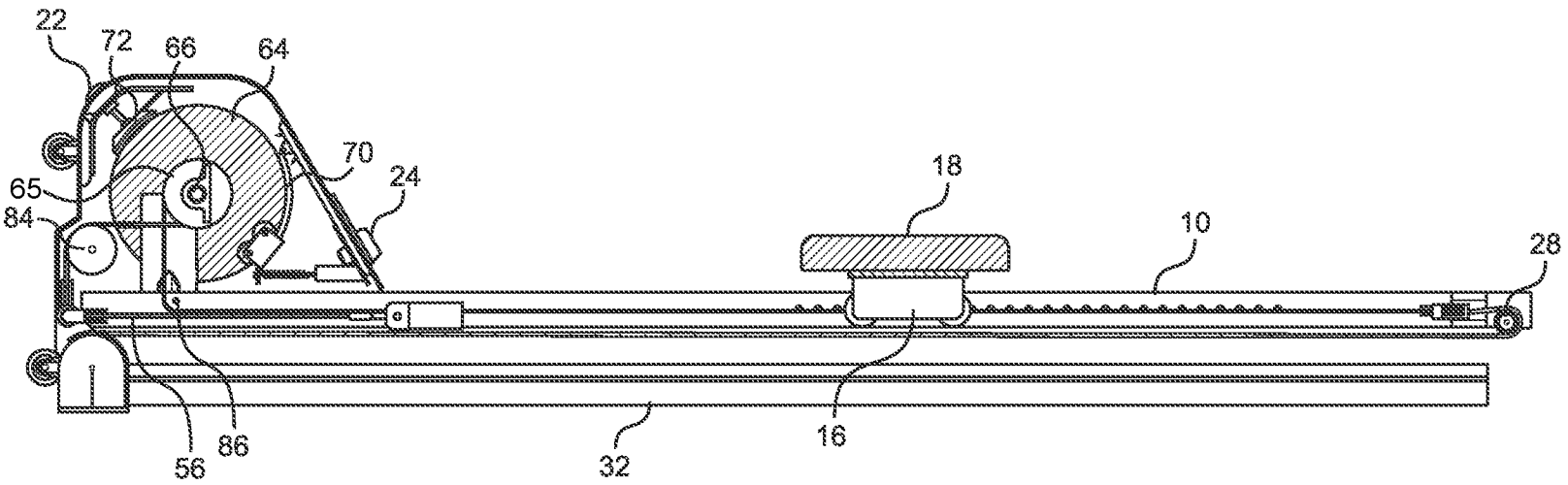
FIG. 4 is a side cross-section view of one embodiment of the present disclosure.
Figure 5:
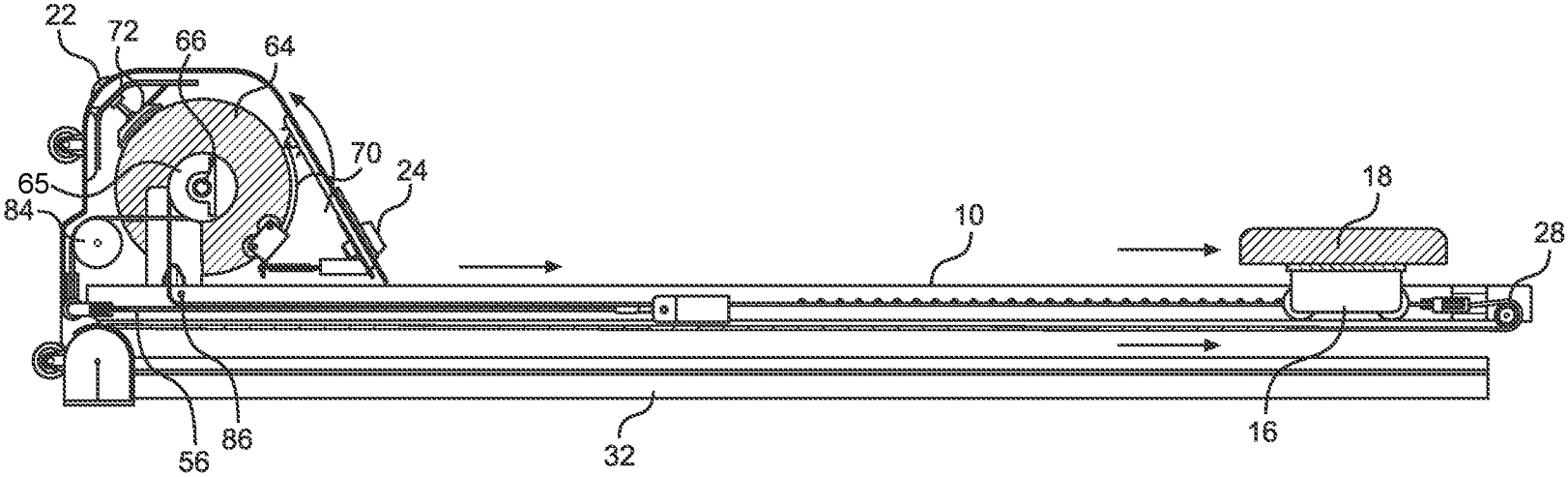
FIG. 5 is a side cross-section view of one embodiment of the present disclosure.
Figure 6:
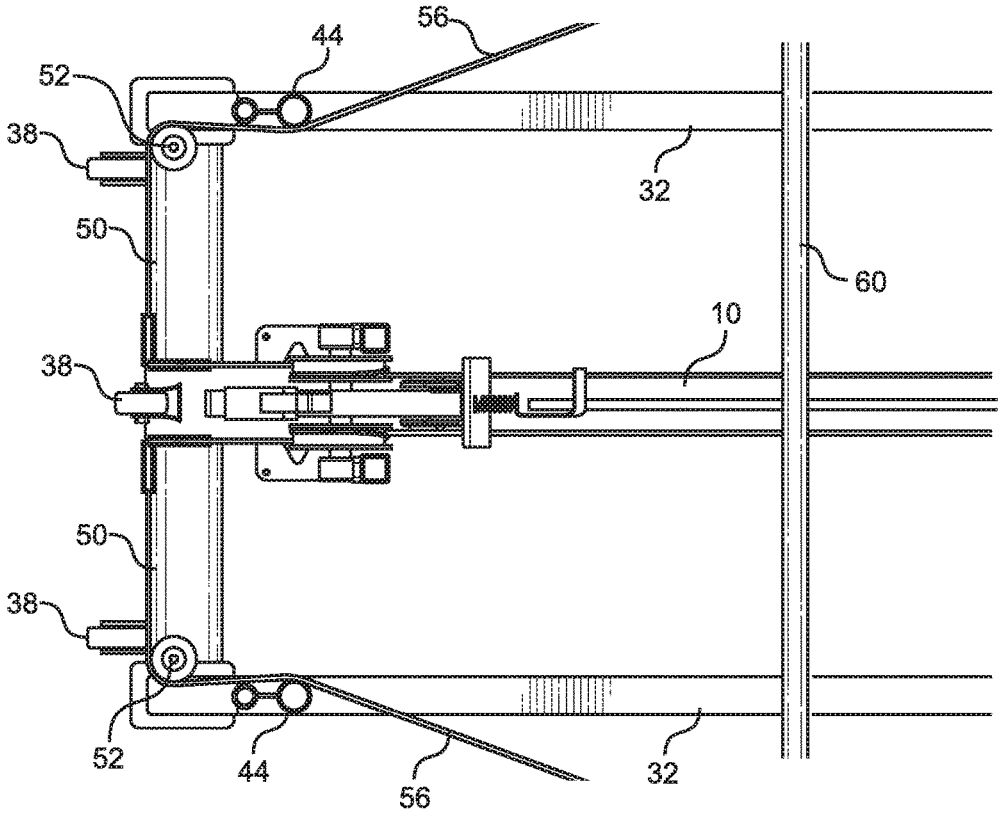
FIG. 6 is a top view of one embodiment of the present disclosure.
Figure 7:
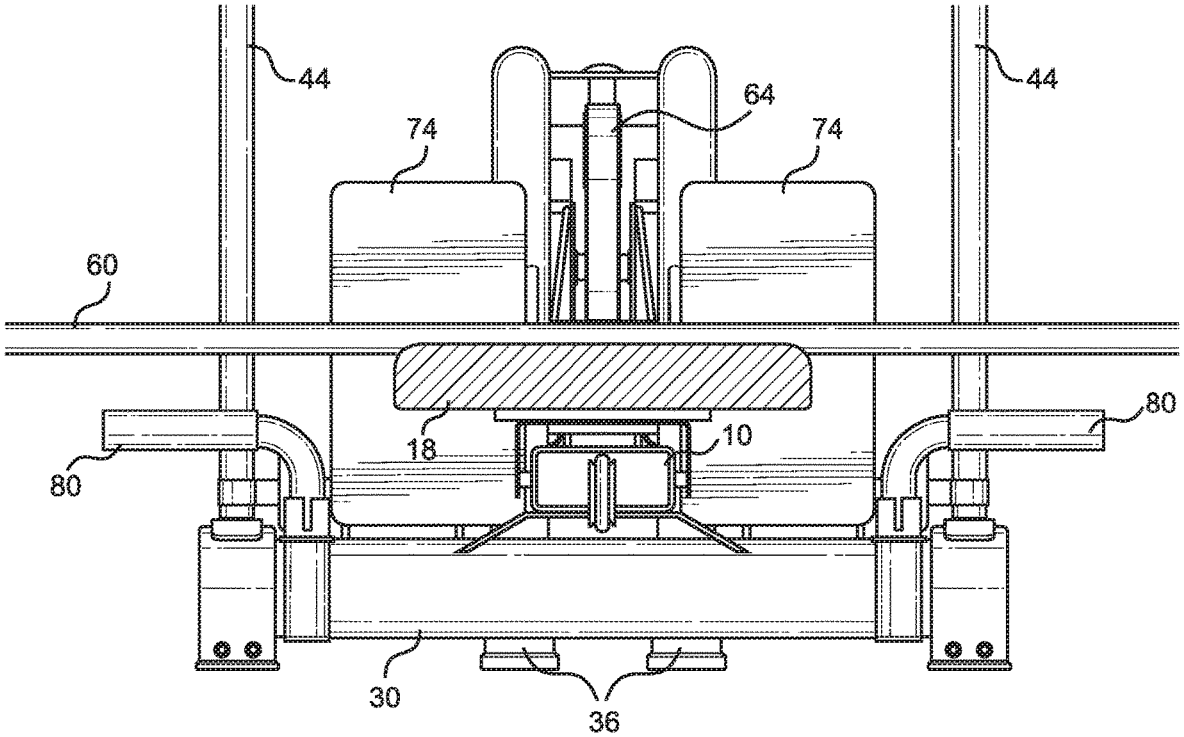
FIG. 7 is a back view of one embodiment of the present disclosure.

As shown in FIG. 3, a pair of flywheel supports 14 may be attached to either side of the center frame rail 10 proximate to the second foot 34, such that a first flywheel support 14 is spaced from a second flywheel support 14 by the center frame rail 10. The flywheel supports 14 may be substantially upside down T-shaped, wherein the upward protruding portion of the flywheel supports 14 may comprise flywheel upright supports 15.

In embodiments, a flywheel 64 may be rotatably suspended between the two flywheel upright supports 15. For example, an axle 66 may extend from the first flywheel upright support 15 to the second flywheel upright support 15 and may be secured to the flywheel upright supports 15 using any suitable fastener, such as a flywheel bearing. The axle 66 may extend through a central hub of the flywheel 64 such that the flywheel 64 may rotate thereon.

In embodiments, the flywheel 64 and the flywheel supports 14 may be covered by a housing 20, wherein the housing 20 extends upward and outward from the second foot 34 toward the first foot 30 and a front surface of the housing 20 includes an angled front surface with a pair of angled housing feet 36, wherein a distal end of each housing foot 36 is designed to be positioned on the ground. A pair of foot rests 74 may be attached to the angled front surface of the housing 20, wherein a first foot rest 74 is positioned on a first side of the center frame rail 10 and a second foot rest is positioned on a second side of the center frame rail 10, such that the pair of foot rests 74 sandwich the center frame rail 10.

In some embodiments, the flywheel 64 may be operatively connected to resistance mechanisms, such that the resistance placed on the flywheel 64 may be varied. For example, the machine may include friction resistance and/or magnetic resistance components. As shown, for example, in FIGS. 4 and 5, the machine may include a friction pad 72 positioned proximate to the flywheel 211 flywheel 64. A friction resistance adjustment knob 22 may be operatively attached to the friction pad 72, such that when the friction resistance adjustment knob 22 is rotated or otherwise activated, the friction pad 72 may move toward and press on or move away from the flywheel 64 providing more or less friction resistance, respectively, as desired. Similarly, a magnet 70 may be positioned proximate to the flywheel 64, wherein a magnetic resistance adjustment knob 24 may be operatively attached to the magnet 70, such that when the magnetic resistance adjustment knob 24 is manipulated, the magnetic strength between the magnet 70 and the flywheel 64 may increase or decrease, thus increasing or decreasing magnetic resistance, as desired. Each of the friction resistance adjustment knob 22 and the magnetic resistance adjustment knob 24, when included, may extend from an area inside the housing 20 to the exterior of the housing 20, such that the knobs 22, 24 may be easily manipulated by a user 78.

The machine of the present disclosure may include a pulley assembly system, wherein movement of a pulley rope 56 routed through the pulley assembly may ultimately cause rotation of the flywheel 64. Thus, when resistance, for example either friction resistance or magnetic resistance, is applied to the flywheel 64, resistance is also applied to the pulley rope 56, wherein the pulley rope 56 may be operatively attached or engaged with an attachments, such as a pull bar 60, a pair of ski poles 44, and a pair of pull handles 76 along with the sliding seat 18. Alternatively, some embodiments of the machine may include a flywheel resistance belt connected to the frame in front of and in the back of the flywheel 64, wherein shortening the length of the tension belt by means of a threaded adjuster may increase the tension of the resistance belt, thus increasing the force required to pull the pull rope 56.

In a particular embodiment, the pulley system may comprise a pair of drive pulleys 65 rotatably mounted on the axle 66, wherein the flywheel 64 may be sandwiched between the pair of drive pulleys 65. A pair of pulley guide wheels 84 may be mounted within the housing 20 on either side of the flywheel 64 proximate to but vertically above the second foot 34, and a pair of small pulleys 82 may be positioned at the rear of the housing 20, wherein a plane of the pair of small pulleys 82 may be substantially perpendicular to a plane of the pair of pulley guide wheels 84. A pair of pulley guides 52 may each be positioned at a junction of the ski rail 32 and the second foot 34, such that each corner of the frame proximate to the housing 20 comprises a pulley guide 52. In some embodiments, a pulley tunnel 50 may extend upwards from the second foot 34 between the small pulley wheel 82 and the pulley guide 52, wherein the pulley tunnel 50 may also function as a raised handle. The pulley system may further comprise a rail pulley guide 86 positioned vertically below the flywheel 64 on either side of the center frame rail 10. A pull rope 56 may be threaded along the pulley system, such that the pull rope 56 is operatively attached to the seat 18 and extends from the seat 18, through the rail pulley guide 86, around the drive pulley 65, to the pulley guide wheel 84, around the small pulleys 82, through the pulley tunnel 50, around the pulley guide 52 and ultimately attach to the desired attachment. For example, a distal end of the pull rope 56 (i.e., the end attaching to the attachment) may comprise a rope clip 58 or other fastener designed to removably engage with the attachment. For example, in the case of the pull bar 60, the pull bar 60 may include a pair of bar rings 62 to which the clips 58 may removably engage Furthermore, as shown in FIG. 3, the pull rope 56 may extend from an area proximate the flywheel 64, through the center frame rail 10, and to an end pulley wheel 28 positioned within an end of the center frame rail 10 distal from the housing 20. An end cap 26 may close off the end of the center frame rail 10 distal from the housing 20.

As described above, the ski rails 32 may extend from the first foot 30 to the second foot 34. A pair of poles 44 may be slidably attached to the ski rails 32 to simulate a cross-country skiing motion and may be attached to the pull rope 56, as described above, for resistance. Specifically, the poles 44 may each be attached to a pole attachment 42 extending from a ski pole carriage 40, wherein the ski pole carriage 40 is designed to slide or roll along a length of the ski rail 32. The pole attachment 42 may have any structure for attaching the pole 44 to the ski pole carriage 40 and, in some embodiments, is pivotably attached to the ski pole carriage 40, such that the poles 44 can extend from the ski rail 32 at any desired angle and, when not in use, can lay flat against the ski rails 32. As shown in the Figures, the pole attachment 42 may be a collar designed to tighten around an end of the ski pole 44. However, in other embodiments, the pole attachment may comprise a post designed to engage with the end of the ski pole 44.

A seat slide track 12, as mentioned above, may be attached to each side surface of the center frame rail 10 and may extend from the first foot 30 to the second foot 34. However, in other embodiments, the seat slide track 12 may be attached to a top surface of the center frame rail 10. In any case, the seat slide track 12 may have a sliding seat 18 slidably mounted thereto, such that the sliding seat 18 may slide along a length of the seat slide track 12. In a particular embodiments, the seat slide track 12 may slidably engage with a seat slide carriage 16, wherein the seat slide carriage 16 is mounted to a bottom surface of the sliding seat 18.

In some embodiments, the frame may include casters 38 attached thereto. For example, the casters 38 may be attached to a surface of the second foot 34 distal from the first foot 30. A caster 38 may also extend from the housing 20. The casters 38 may allow for movement of the machine when the machine is stood on its end. In such embodiments, the first foot 30 may include at least one, such as a pair of, frame handles 80 extending upward therefrom, such that the frame handles 80 may be used to move the machine.

In embodiments, the machine of the present disclosure may include a few optional features. For example, an electronic device 88 may be attached to the housing 20 via an electronic device stand 90 extending from the housing 20. The electronic device 88 may be a monitor, a touchscreen computer, a tablet computer, a radio, a video screen, or the like.

Figure 8:
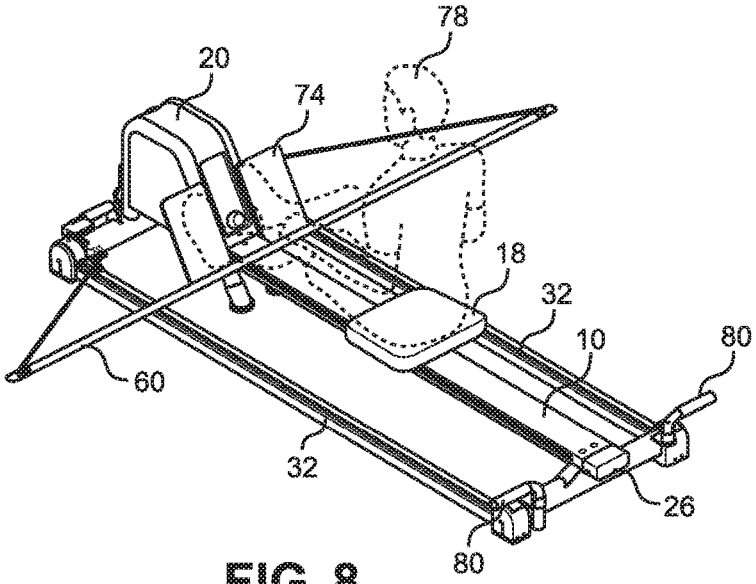
FIG. 8 is a perspective view of one embodiment of the present disclosure, shown in use.
Figure 9:
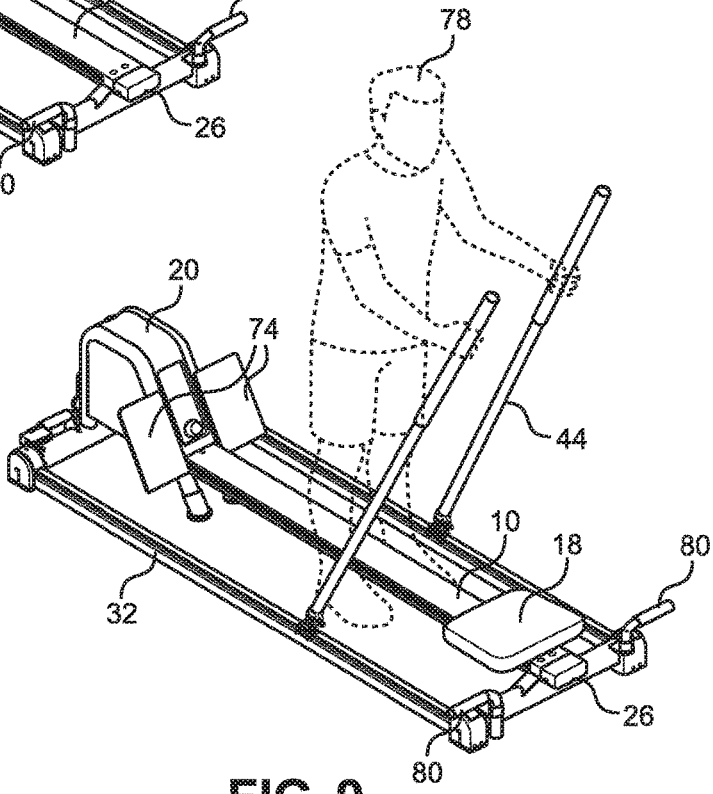
FIG. 9 is a perspective view of one embodiment of the present disclosure, shown in use.
Figure 10:
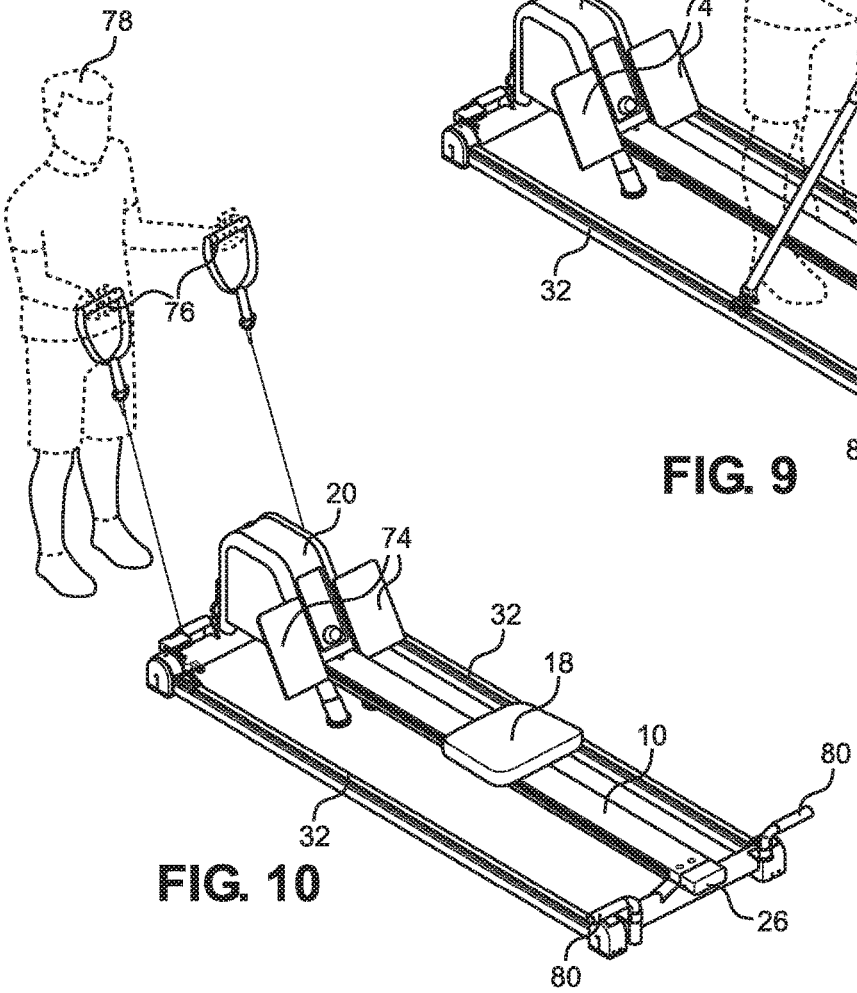
FIG. 10 is a perspective view of one embodiment of the present disclosure, shown in use.

To use the device of the present disclosure, a user 78 may first determine the type of activity desired to be performed. If rowing exercises are desired, the user 78 may sit on the sliding seat 18 with his or her feet planted on the foot rests 74 and complete the rowing motion by pulling on the pull bar 60 while sliding the sliding seat 18 along the length of the seat slide 16, as shown in FIG. 8. If a skiing exercise is desired, the user may stand proximate to and between the ski rails 32 and mimic skiing movements using the poles 44, as shown in FIG. 9. If weight training or resistance training is desired, handles 76 may be attached to the pull rope 56, and the user may stand away from the frame and complete the desired resistance training, as shown in FIG. 10.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A multifunctional cardiovascular exercise machine for practicing a plurality of types of cardiovascular and weight training exercises, the multifunctional cardiovascular exercise machine comprising:

a frame defining a horizontal portion of the multifunctional cardiovascular exercise machine, the frame comprising:

a first foot;

a second foot distal from the first foot;

a pair of ski rails attaching the first foot to the second foot; and a center frame rail extending from a central portion of the first foot to a central portion of the second foot;

a flywheel operatively mounted to the frame;

a pulley system mounted to the frame, the pulley system supporting and routing a pull rope, wherein the pull rope is operatively engaged with the flywheel and a free end of the pull rope is configured to be removably engaged with at least one attachment;

a sliding seat slidably mounted to the frame and configured to support a user thereon;

a pair of ski poles slidably mounted to the pair of ski rails; and a pair of footrests mounted to the frame.

2. The multifunctional cardiovascular exercise machine of claim 1, further comprising a pair of flywheel supports attached to either side of the center frame rail proximate to the second foot, such that a first flywheel support of the pair of flywheel supports is spaced from a second flywheel support of the pair of flywheel supports by the center frame rail, and wherein each of the pair of flywheel supports are upside down T-shaped, wherein an upward protruding portion of each of the pair of flywheel supports comprises a flywheel upright support.

3. The multifunctional cardiovascular exercise machine of claim 2, wherein:

an axle extends from a first of the flywheel upright supports to a second of the flywheel upright supports; and the axle extends through a central hub of the flywheel, such that the flywheel is capable of rotating thereon.

4. The multifunctional cardiovascular exercise machine of claim 3, wherein the pulley system comprises:

a pair of drive pulleys rotatably mounted on the axle, wherein the flywheel is sandwiched between the pair of drive pulleys;

a pair of pulley guide wheels mounted within a housing on either side of the flywheel proximate to and vertically above the second foot;

a pair of small pulleys positioned at a rear of the housing, wherein a plane of the pair of small pulleys is perpendicular to a plane of the pair of pulley guide wheels;

a pair of pulley guides, wherein each of the pair of pulley guides is positioned at a junction of a respective ski rail of the pair of ski rails and the second foot; and a rail pulley guide positioned vertically below the flywheel on either side of the center frame rail.

5. The multifunctional cardiovascular exercise machine of claim 4, further comprising a pulley tunnel extending upwards from the second foot between each small pulley wheel of the pair of small pulley wheels and a respective pulley guide of the pair of pulley guides.

6. The multifunctional cardiovascular exercise machine of claim 1, wherein the at least one attachment is selected from the group consisting of a pull bar, the pair of ski poles, and a pair of pull handles.

7. The multifunctional cardiovascular exercise machine of claim 6, wherein the pull rope is configured to be removably and interchangeably engaged with the pull bar, the pair of ski poles, and the pair of pull handles.

8. The multifunctional cardiovascular exercise machine of claim 1, wherein:

the center frame rail is positioned between and parallel to the pair of ski rails; and the center frame rail comprises a seat slide track built into a surface thereof, wherein the sliding seat is mounted to a seat carriage that is slidably mounted to the seat slide track.

9. The multifunctional cardiovascular exercise machine of claim 1, further comprising a housing surrounding the flywheel, wherein the pair of footrests is attached to a surface of the housing facing the first foot of the frame.

* * * * *